US006862747B2

(12) United States Patent
Oleson

(10) Patent No.: US 6,862,747 B2
(45) Date of Patent: Mar. 8, 2005

(54) PROTECTIVE HELMET WITH VERTICALLY ADJUSTABLE HEADBAND

(75) Inventor: Richard Alan Oleson, Lexington, KY (US)

(73) Assignee: E.D. Bullard Company, Cynthiana, KY (US)

( * ) Notice: Subject to any disclaimer, the term of this patent is extended or adjusted under 35 U.S.C. 154(b) by 0 days.

(21) Appl. No.: 10/782,241

(22) Filed: Feb. 18, 2004

(65) Prior Publication Data

US 2004/0163160 A1 Aug. 26, 2004

Related U.S. Application Data

(60) Provisional application No. 60/449,910, filed on Feb. 25, 2003.

(51) Int. Cl.[7] ..... A42B 3/00
(52) U.S. Cl. ..... 2/416
(58) Field of Search ..... 2/416, 417, 418, 2/419, 420, 411

(56) References Cited

U.S. PATENT DOCUMENTS

| | | | | | |
|---|---|---|---|---|---|
| 2,964,753 | A | | 12/1960 | Austin | |
| 2,964,754 | A | * | 12/1960 | Austin | 2/417 |
| 2,967,304 | A | * | 1/1961 | Austin | 2/417 |
| 3,087,164 | A | * | 4/1963 | Gilbert | 2/419 |
| 3,268,911 | A | * | 8/1966 | Cox | 2/416 |
| 3,383,705 | A | * | 5/1968 | Raschke | 2/416 |
| 3,510,879 | A | * | 5/1970 | Webb | 2/416 |
| 3,599,239 | A | * | 8/1971 | Tatum | 2/416 |
| 3,758,889 | A | * | 9/1973 | Erb | 2/416 |
| 4,000,520 | A | | 1/1977 | Svendsen et al. | |
| 4,286,339 | A | | 9/1981 | Coombs | |
| 5,042,093 | A | * | 8/1991 | Legendre | 2/419 |
| 5,129,108 | A | | 7/1992 | Copeland et al. | |
| 5,898,949 | A | | 5/1999 | Barthold et al. | |
| 6,032,297 | A | * | 3/2000 | Barthold et al. | 2/416 |
| 6,081,931 | A | * | 7/2000 | Burns et al. | 2/411 |

FOREIGN PATENT DOCUMENTS

| | | |
|---|---|---|
| EP | 0 321 934 A1 | 6/1989 |
| WO | WO 95/01739 A1 | 1/1995 |

OTHER PUBLICATIONS

European Patent Office, European Search Report for application No. EP 04 25 1037, Jun. 10, 2004.

* cited by examiner

*Primary Examiner*—Rodney M. Lindsey
(74) *Attorney, Agent, or Firm*—Stites & Harbison, PLLC; David W. Nagle, Jr.; Mandy V. Wilson

(57) ABSTRACT

A protective helmet includes a substantially rigid outer shell defining a bottom opening and an internal cavity for receiving a wearer's head; an inner ring positioned substantially within and secured to the outer shell; a suspension secured to the inner ring and including at least two suspension straps; and a headband positioned substantially within the outer shell and adjacent the bottom opening of the outer shell, wherein the position of the headband relative to the inner ring can be manipulated, effectively adjusting the vertical position of the headband within and relative to the outer shell.

14 Claims, 8 Drawing Sheets

PROTECTIVE HELMET WITH VERTICALLY ADJUSTABLE HEADBAND

CROSS REFERENCES TO RELATED APPLICATIONS

This application claims priority to U.S. Provisional Application Ser. No. 60/449,910 filed Feb. 25, 2003, the entire disclosure of which is incorporated herein by this reference.

FIELD OF THE INVENTION

The present invention relates to a protective helmet, such as a hard hat or fire helmet, and, more particularly, to a protective helmet with a headband whose vertical position within the protective helmet can be quickly, easily, and efficiently adjusted.

BACKGROUND OF THE INVENTION

Hard hats, fire helmets, and similar protective helmets are commonly comprised of a shell and a suspension contained within the shell. The shell and suspension cooperate to provide the requisite level of protection. Specifically, the shell of the protective helmet causes any force of impact to be spread across the surface area of the shell. The suspension of the protective helmet separates the wearer's head from the shell such that there is an air gap between the shell and the wearer's head that provides for further attenuation of the force of an impact to the shell. When an object strikes the shell of the hard hat, the shell itself flexes inward and the straps of the suspension will stretch. The air gap accommodates the flexing of the shell and stretching of the straps, but, under normal conditions, prevents the wearer's head from contacting the shell of the protective helmet.

A typical suspension comprises a headband and one or more straps, the ends of each strap being secured to opposite sides of the helmet such that they extend over the top of the head of the wearer. Together, the headband and straps define a cavity for receiving the head of the wearer. The circumference of the headband may be adjustable to accommodate different head sizes. Furthermore, in some cases, the vertical position of the headband within the shell of the helmet may be adjusted. Such adjustments allow the wearer to find the most comfortable and stable position for the helmet on their head, and such adjustments also allow the helmet to better accommodate a wearer using other necessary equipment, for example, a firefighter using a self-contained breathing apparatus or a flash hood, each of which is often worn at the same time as the helmet.

In many existing designs, the circumference of the headband may be easily and quickly adjusted by a ratchet knob or similar mechanical means, even while the helmet is being worn. However, the vertical adjustment of the headband within the shell of the helmet, if provided for at all, generally requires removal of the helmet and then a time-consuming and awkward partial disassembly of the helmet. In other words, the vertical adjustment is difficult, if not impossible, to accomplish in severe environments, such as those commonly encountered by a wearer of a protective helmet, such as a firefighter.

It is therefore a paramount object of the present invention to provide a protective helmet with a headband whose vertical position within the protective helmet can be quickly, easily, and efficiently adjusted, thus allowing a wearer to accomplish the adjustment in various conditions, including in the severe environments commonly encountered by a wearer of a protective helmet.

This and other objects and advantages of the present invention will become apparent upon a reading of the following description.

SUMMARY OF THE INVENTION

The present invention is a protective helmet with a headband whose vertical position within the protective helmet can be quickly, easily, and efficiently adjusted, thus allowing a wearer to accomplish the vertical adjustment in various conditions, including in the severe environments commonly encountered by a wearer of a protective helmet.

An exemplary embodiment of the helmet of the present invention includes an outer shell; an inner shell; an inner ring; one or more suspension straps secured to the inner ring; a headband; and an adjustment mechanism for adjusting the vertical position of the headband within and relative to the outer shell. With regard to the relative positioning of the components of the helmet, the inner shell is positioned within, but spaced away from, the outer shell, such that a cavity is defined between the outer shell and the inner shell. The headband is then positioned within the inner ring such that the outer surface of the headband abuts the inner surface of the inner ring. A cradle portion of the headband is wrapped around the inner ring such that the inner ring is sandwiched between the outer surface of the headband and the cradle portion of the headband, thus securing the inner ring relative to the headband.

The vertical adjustment mechanism, having an integral control button extending from a central portion thereof, is positioned such that it abuts the outer surface of the inner ring with the control button extending through an aperture defined through the inner ring. Side portions, extending from either side of the central portion of the vertical adjustment mechanism are attached to the headband. The assembly of the inner ring, headband, and vertical adjustment mechanism assembly is then positioned in the cavity between the inner and outer shells adjacent the rim of the inner shell, with the inner ring being secured to the outer shell of the helmet.

Detents or indentations are defined at vertically spaced intervals along the adjustment mechanism, preferably on either side of the control button, each of which is adapted to receive and mate with a respective boss extending from the outer surface of the ring on either side of the aperture. When the bosses are so mated with the detents of the adjustment mechanism, the adjustment mechanism is prevented from vertical movement with respect to the inner ring. However, when the wearer wishes to adjust the vertical position of the headband, pressure may be applied to the control button by placing the thumb or another finger through the aperture defined by the inner ring. By applying a generally upward or downward pressure to the control button, the adjustment mechanism, along with the headband secured to the adjustment mechanism, is moved substantially vertically with respect to the inner ring. Specifically, when an adequate pressure is provided, the bosses extending from the inner surface of the ring are disengaged from the selected detents. Continued application of pressure causes the adjustment mechanism to slide against the outer surface of the ring until the bosses engage the next set of detents.

DETAILED DESCRIPTION OF THE INVENTION

The present invention is a protective helmet with a headband whose vertical position within the protective helmet can be quickly, easily, and efficiently adjusted, thus allowing a wearer to accomplish the vertical adjustment in various conditions, including in the severe environments commonly encountered by a wearer of a protective helmet.

Figure 1:
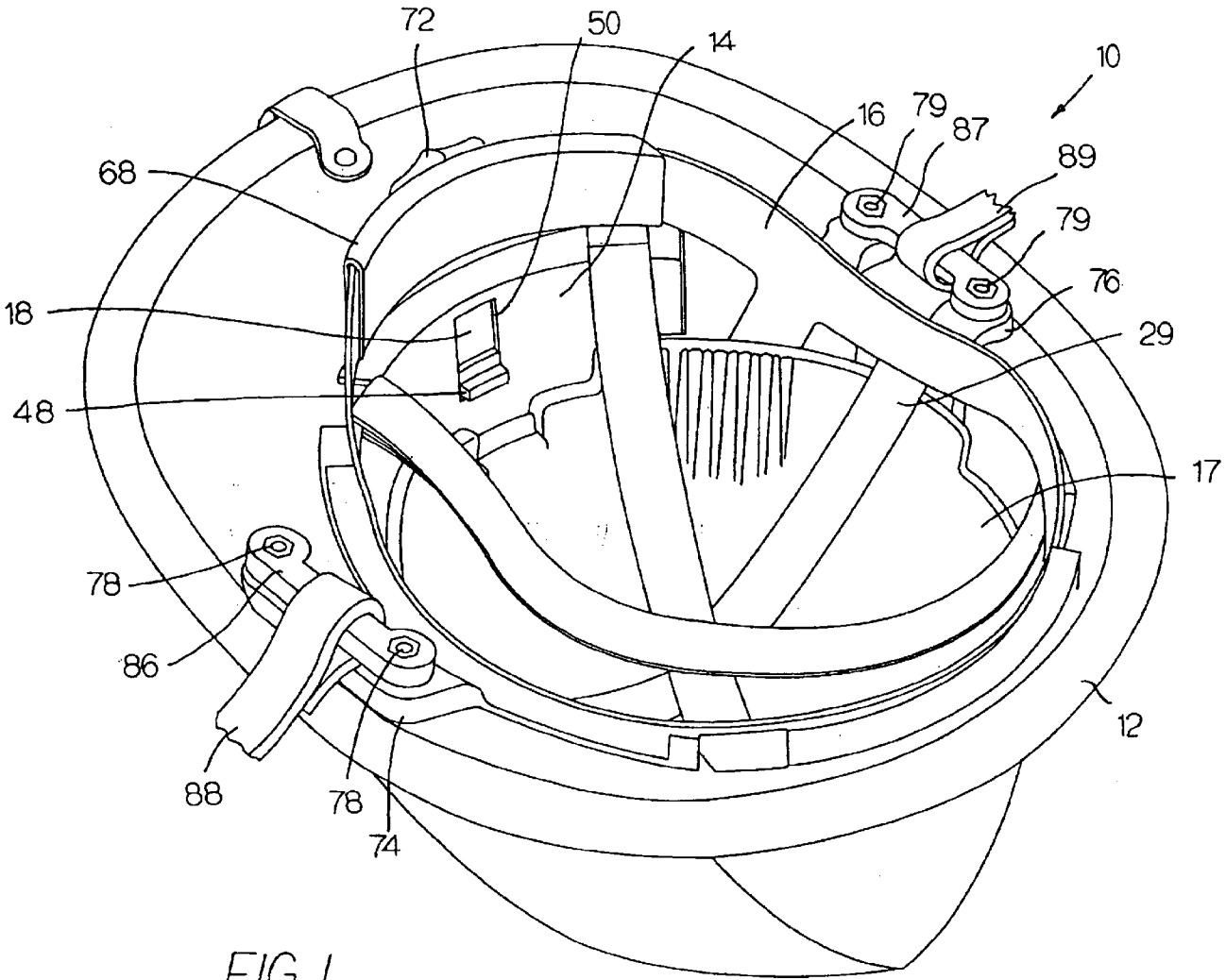
FIG. 1 is a perspective view of a protective helmet with a vertically adjustable headband made in accordance with the present invention.
Figure 2:
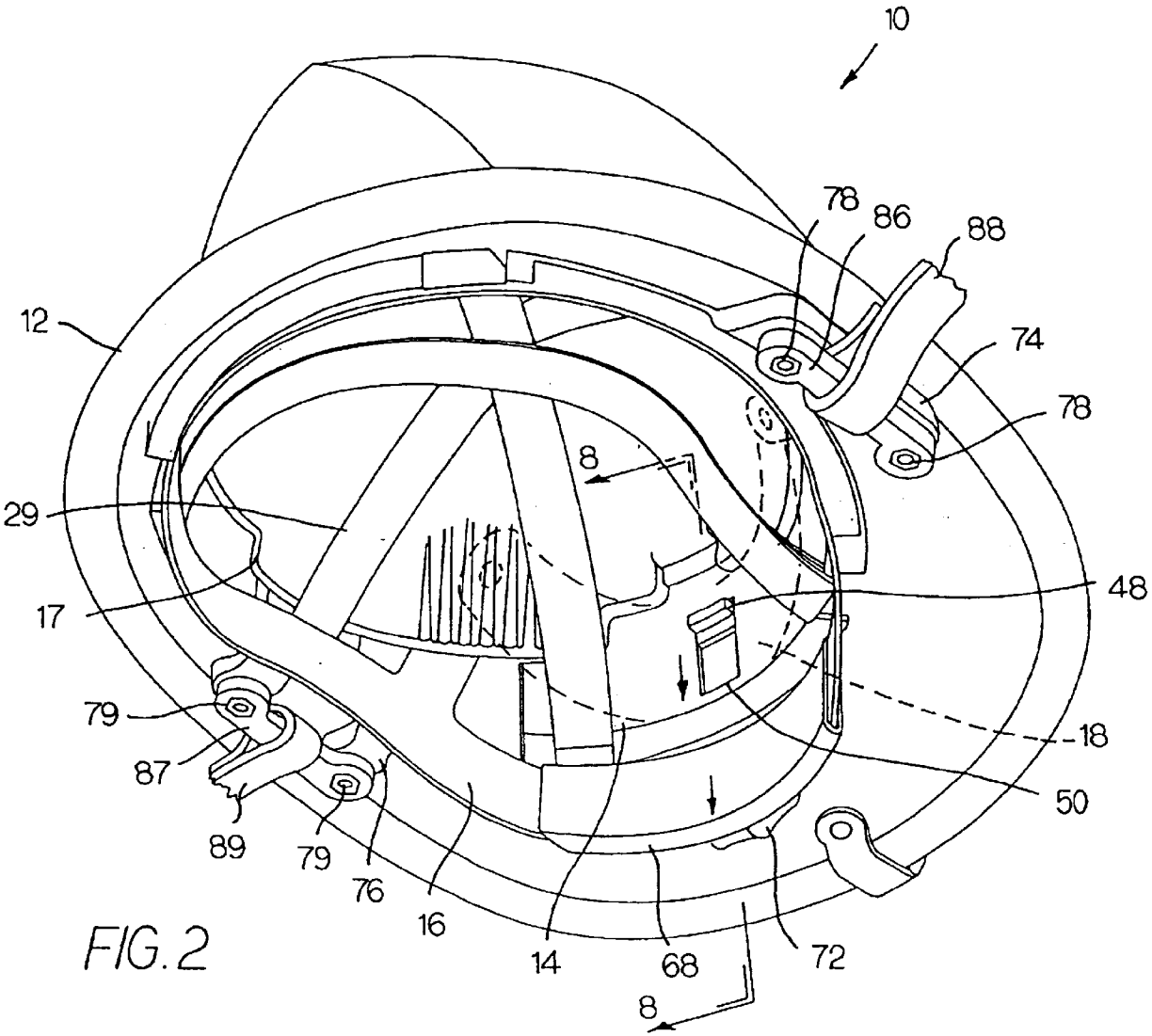
FIG. 2 is an alternate perspective view of the protective helmet of FIG. 1.
Figure 3:
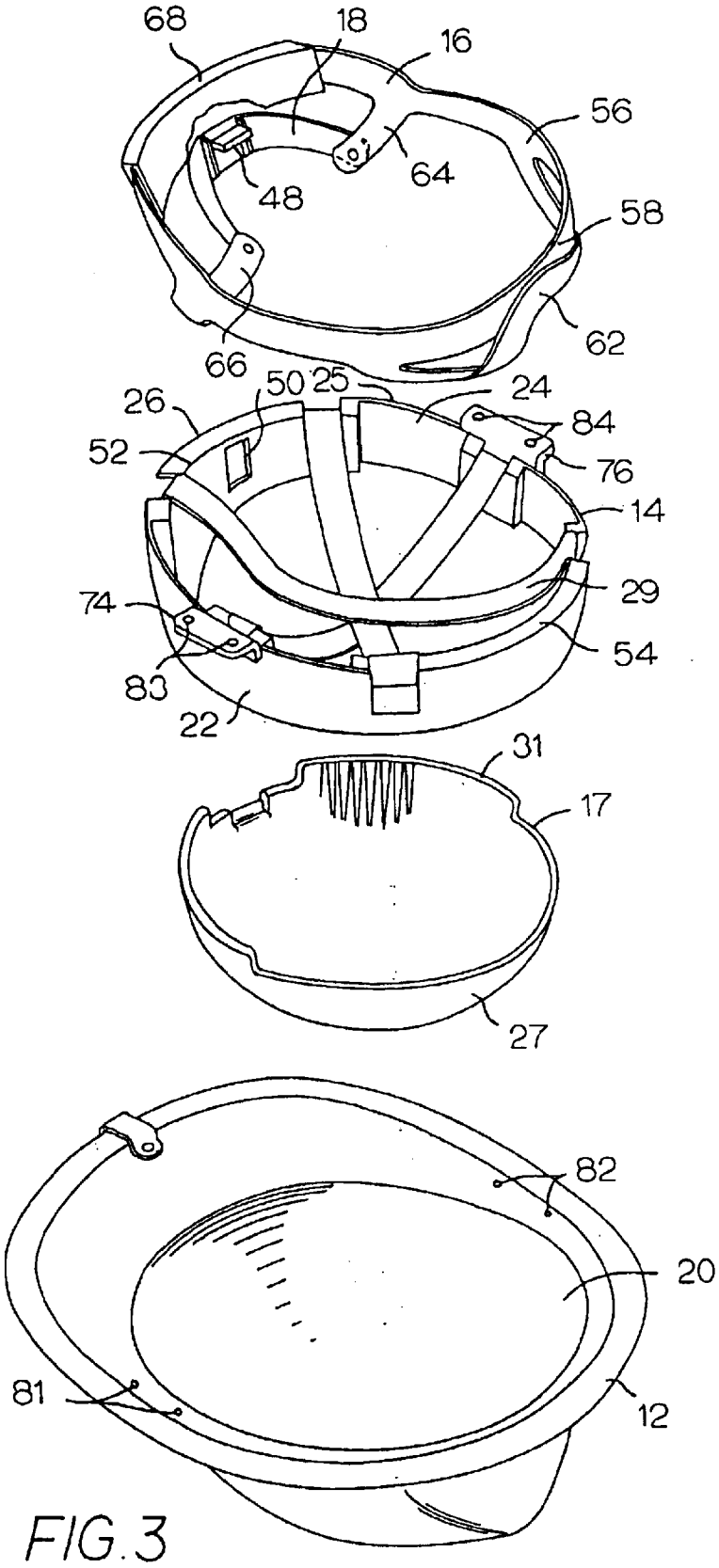
FIG. 3 is an exploded perspective view of the protective helmet of FIG. 1.

Referring to FIGS. 1 through 3, an exemplary embodiment of the helmet 10 of the present invention generally includes a substantially rigid outer shell 12; an inner shell 17; an inner ring 14; one or more suspension straps 29 secured to the inner ring 14; a headband 16; and an adjustment mechanism 18 for adjusting the vertical position of the headband 16 within and relative to the outer shell 12.

The focus of the present application is on the vertical adjustment mechanism 18 and the manner in which it is operated; however, in order to understand the context in which the vertical adjustment mechanism 18 operates, each individual component of the exemplary embodiment of the helmet 10 and the relative positioning of these components will first be described.

Figure 4:
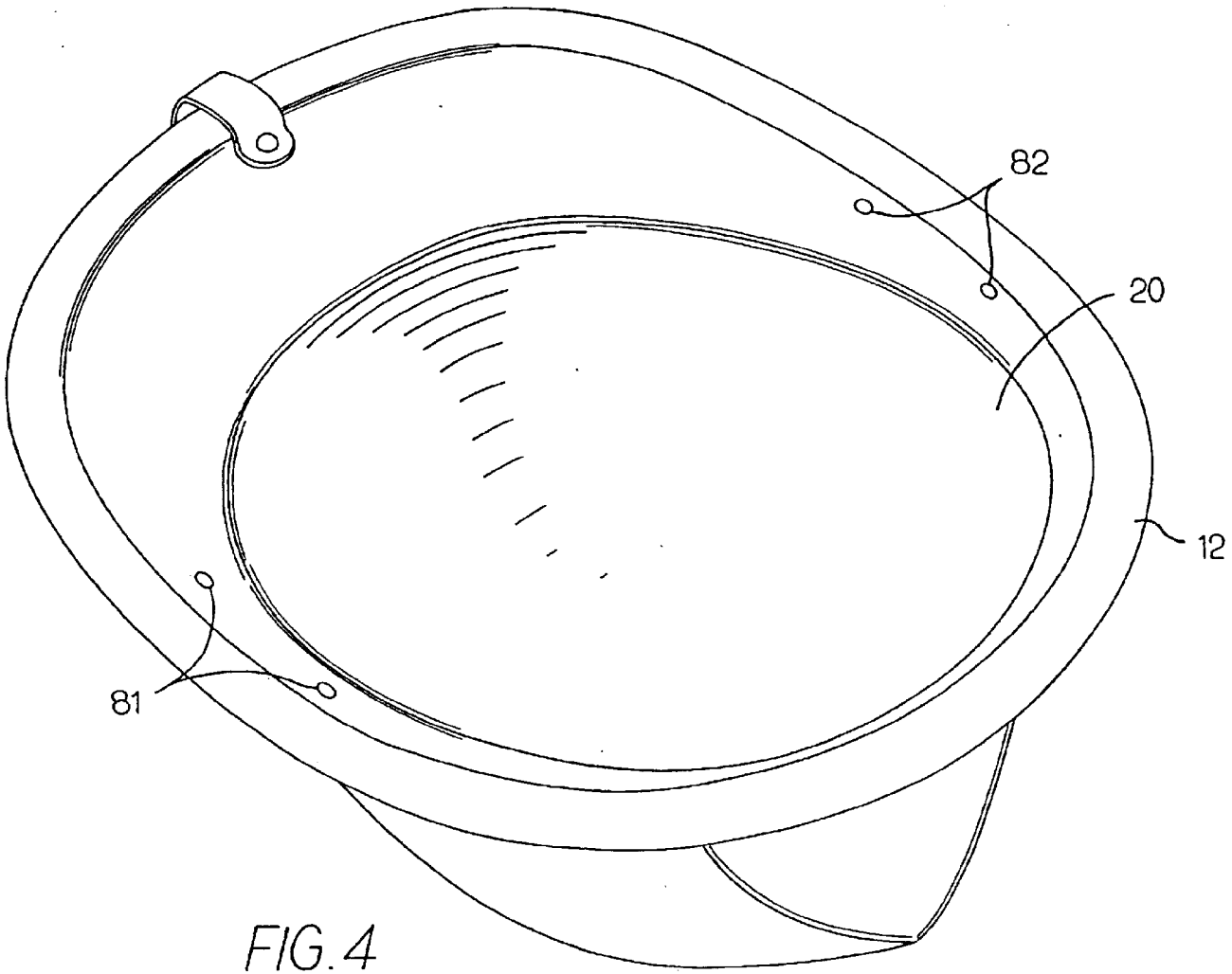
FIG. 4 is a perspective view of the outer shell of the protective helmet of FIG. 1.
Figure 6:
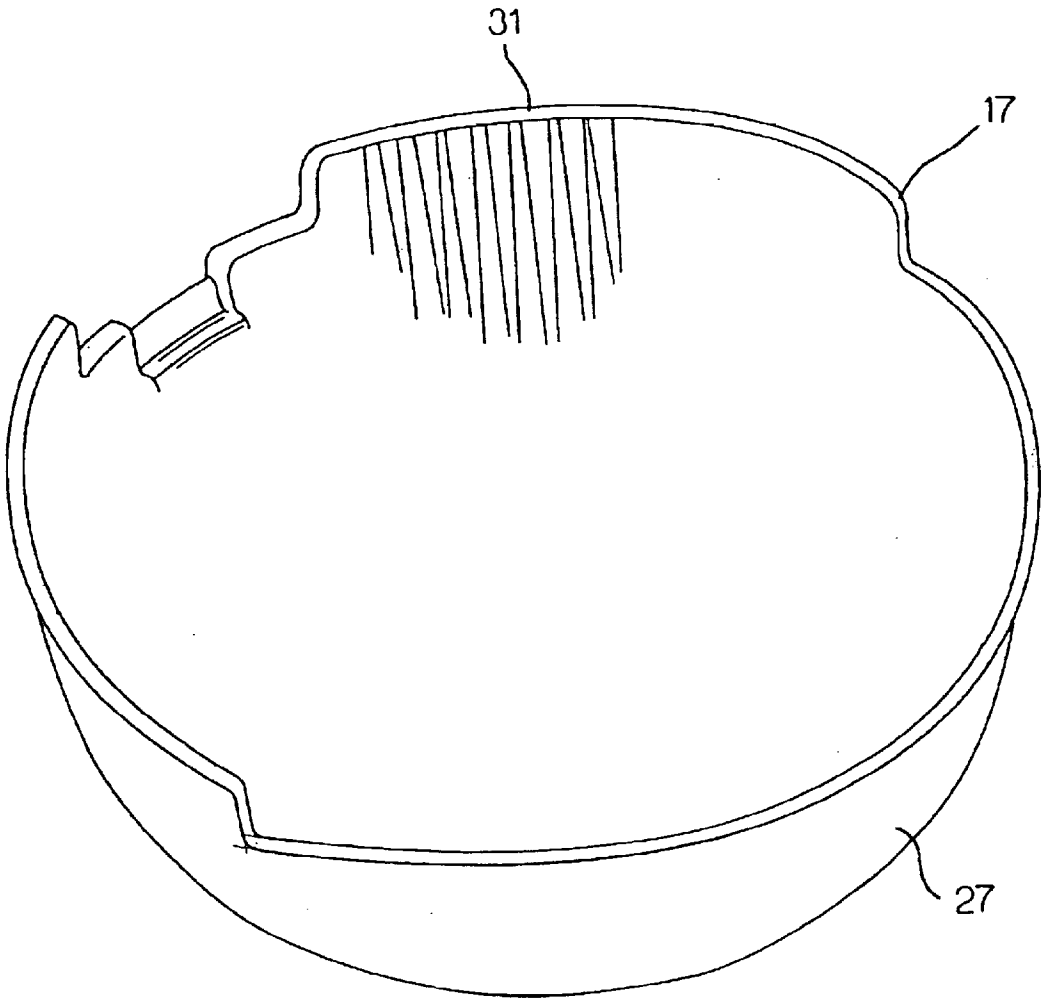
FIG. 6 is a perspective view of the inner shell of the protective helmet of FIG. 1.

With regard to the individual components of the helmet 10, and referring now to FIG. 4, the outer shell 12 has an inner surface 20 and defines an opening and an internal cavity for receiving additional components of the helmet 10 and the wearer's head. The outer shell 12 is preferably constructed from a substantially rigid material, for example, a thermoplastic or fiberglass composite. Referring now to FIG. 6, the inner shell 17 is adapted and shaped to be positioned within the outer shell, also defining an opening and an internal cavity for receiving the wearer's head and including an outer surface 27 terminating at a circumferential rim 31. The inner shell 17 is also preferably constructed from a substantially rigid material, such as a molded thermoplastic. The inner shell 17, like the outer shell 12, provides protection for the wearer by absorbing and attenuating some of the force of an impact to the protective helmet 10.

Figure 7:
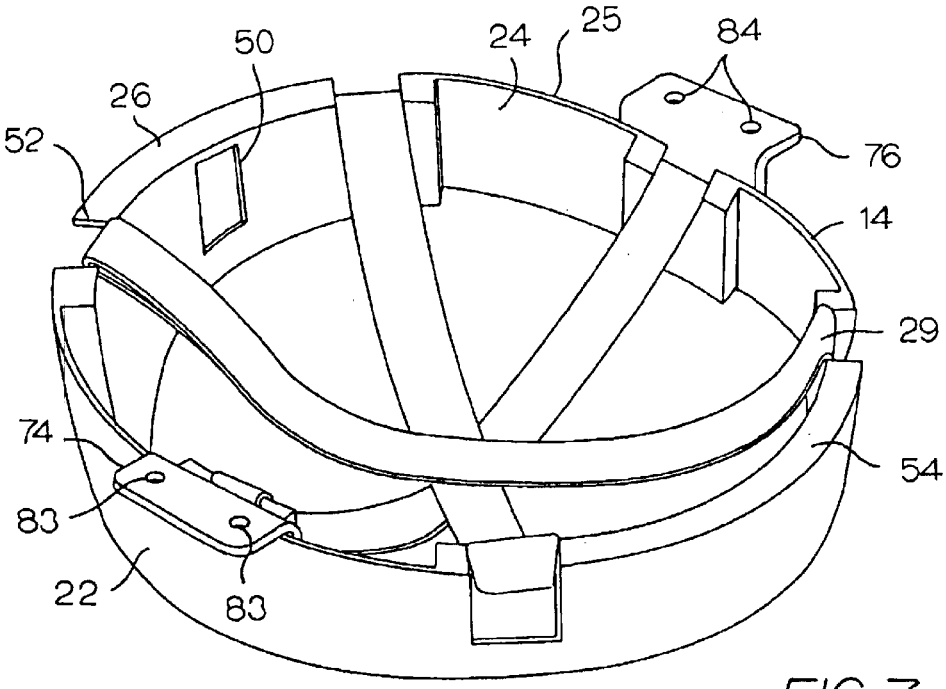
FIG. 7 is a perspective view of the inner ring of the protective helmet of FIG. 1.

Referring now to FIG. 7, the inner ring 14 has an outer surface 22, an inner surface 24, and an edge 25 circumscribing an opening for receiving a wearer's head. A series of suspension straps 29 are secured to the inner ring 14. In this regard, in this exemplary embodiment, the suspensions straps 29 are removably secured to the inner ring 14 to facilitate the assembly of the helmet 10 and to allow for replacement or interchanging of the suspension straps 29. The inner ring 14 additionally defines an aperture 50, the importance of which will be described below. As shown in FIG. 7, this aperture 50 is defined through a rear portion 52 of the inner ring 14, as opposed to a front portion 54. Finally, the inner ring 14 also has an integral flange 26 that extends from the edge 25 of the inner ring 14, the importance of which will also be described below.

Figure 5:
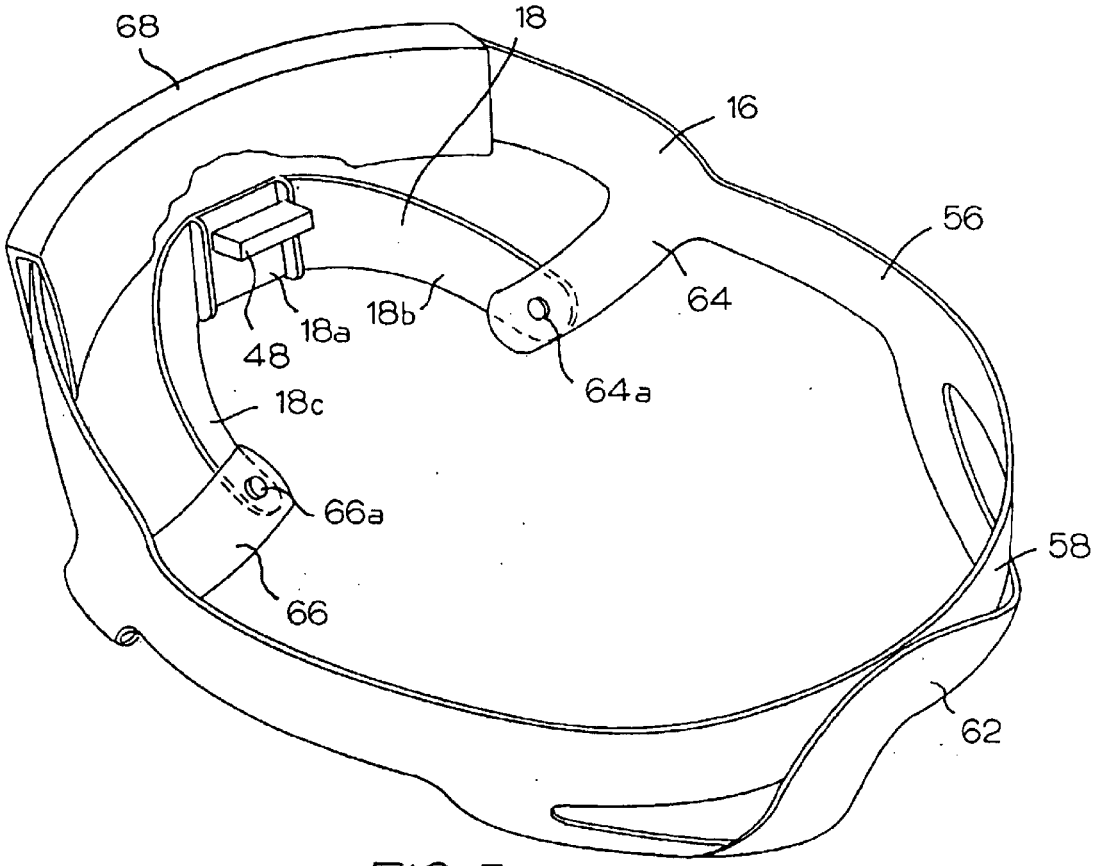
FIG. 5 is a perspective view of the headband and vertical adjustment mechanism of the protective helmet of FIG. 1.

Referring now to FIG. 5, the headband 16 generally includes a circumferential strap 56 circumscribing an opening for receiving the wearer's head. The headband 16 also includes a brow portion 58, a cradle 62 for supporting the inner ring 14 (as will be described further below), and a pair of arms 64, 66 extending from the circumferential strap 56 for connecting the headband 16 to the vertical adjustment mechanism 18 (as will also be described further below). In this exemplary embodiment, the headband 16 additionally includes a housing 68 containing a mechanism for adjusting the circumference of the strap 56, for example, the mechanism described in commonly assigned U.S. Pat. No. 4,888,831, the entire disclosure of which is incorporated herein by this reference. Specifically, the '831 Patent describes an adjusting or ratchet mechanism which allows overlapping rear end portions of the head strap to be adjusted. An adjusting knob 72 (shown in FIGS. 1, 2 and 8) extends from the housing 68 facing away from the head of the wearer, allowing the circumference of the strap 56 to be adjusted through rotation of the knob 72, even while the headband 16 is situated on the head of the wearer.

Referring still to FIG. 5, the vertical adjustment mechanism 18 preferably has a one-piece construction, but may be described with reference to various portions. Specifically, the vertical adjustment mechanism 18 includes a central portion 18*a* and side portions 18*b*, 18*c* extending from either side of the central portion 18*a*. The central portion 18*a* includes an integral control button 48, which projects from the surface of the mechanism 18, the importance of which will be described below. The side portions 18*b*, 18*c* extend toward and are adapted to be secured to the respective arms 64, 66 of the headband 16. Specifically, in this exemplary embodiment, the side portions 18*b*, 18*c* of the vertical adjustment mechanism 18 are provided with receptacles corresponding to respective mating projections 64*a*, 66*a* extending from the arms 64, 66 of the headband 16. However, various other attachment means may be used to secure the headband 16 to the vertical adjustment mechanism 18 without departing from the spirit and scope of the present invention.

The relative positioning of the internal components of the helmet 10 will now be discussed with reference to FIG. 3. The inner shell 17 is positioned within, but spaced away from, the outer shell 12, such that a cavity is defined between the outer shell 12 and the inner shell 17. In this regard, it is contemplated that foam or a similar material be used to substantially fill the cavity, providing support for the inner shell 17 and further attenuating the forces resulting from an impact to the helmet 10. In any event, a space remains between the shells 12, 17 adjacent the rim 31 of the inner shell 17, the importance of which will be described below Referring still to FIG. 3, and with additional reference to FIG. 3A, the headband 16 (with the vertical adjustment mechanism 18 detached therefrom) is positioned within the inner ring 14 such that the brow portion 58 of the headband 16 abuts the inner surface 24 of the front portion 54 of the inner ring 14, and the arms 64, 66 of the headband 16 abut and extend beyond the inner surface 24 near the rear portion 52 of the inner ring 14. The headband 16 is connected to the inner ring 14 by wrapping the cradle 62 around the front portion 54 of the inner ring 14, sandwiching the front portion 54 between the brow portion 58 and the cradle 62. The vertical adjustment mechanism 18 is then positioned such that it abuts the outer surface 22 of the inner ring 14, with the control button 48 extending through the aperture 50 defined by the inner ring 14.

Figure 3A:
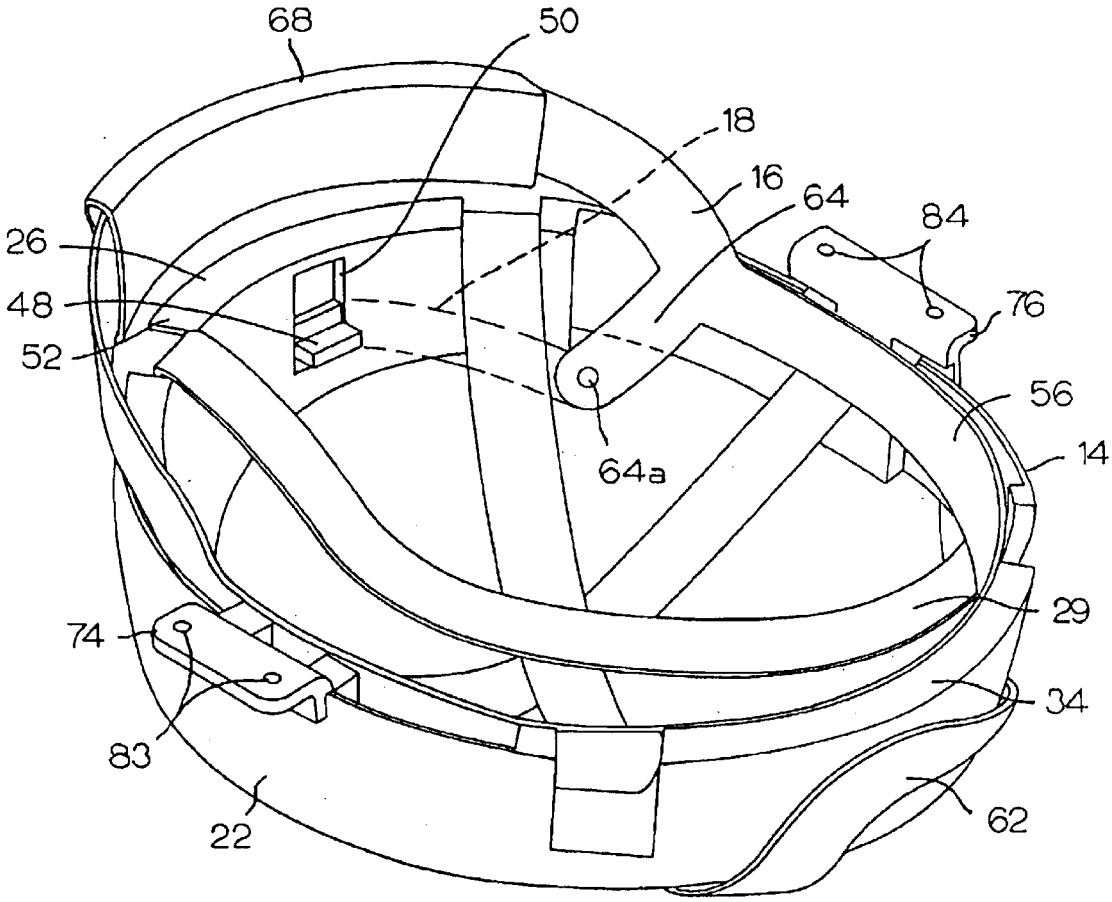
FIG. 3A is a perspective view of the inner ring, headband and vertical adjustment mechanism of the protective helmet of FIG. 1.

The assembly of the inner ring 14, headband 16, and vertical adjustment mechanism 18, as shown in FIG. 3A, is positioned in the space remaining between the shells 12, 17 adjacent the rim 31 of the inner shell 17, as shown in FIGS. 1 and 2.

Finally, with reference to FIG. 1, the inner ring 14 is secured to the outer shell 12 of the helmet 10. In this exemplary embodiment, such attachment is accomplished by a pair of integral brackets 74, 76 that extend from opposite sides of the inner ring 14. These brackets 74, 76 include holes 83, 84 which correspond with holes 81, 82 defined through the outer shell 12 (as shown in FIGS. 3, 3A and 4). The holes 83, 84 defined through the brackets 74, 76 are placed in registry with the holes 81, 82 defined through the through the outer shell 12, such that bolts or similar fasteners 78, 79 can be passed through the holes 81, 82, 83, 84, securing the inner ring 14 to the outer shell 12. Furthermore, in this exemplary embodiment, a pair of bars 86, 87 are positioned on either side of the outer shell 12, with holes in registry with the holes 81, 82, 83, 84 defined by the outer shell 12 and inner ring 14, such that the bolts or similar fasteners 78, 79 also pass through and secure these bars 86, 87 to the helmet 10. These bars 86, 87 are used as an attachment point for the first and second portions 88, 89 of a chinstrap.

Although attention has been given above to the various structural features of and the assembly of one exemplary embodiment of a helmet 10 made in accordance with the present invention, the focus of the present application is the vertical adjustment capability. As such, the vertical adjustment mechanism 18 and the manner in which it is operated will now be described in more detail. It should also be noted that various alterations to the components of the helmet 10 and the assembly thereof may be made without departing from the spirit and scope of the present invention, so long as the vertical adjustment capability of the helmet 10 is maintained.

Figure 8:
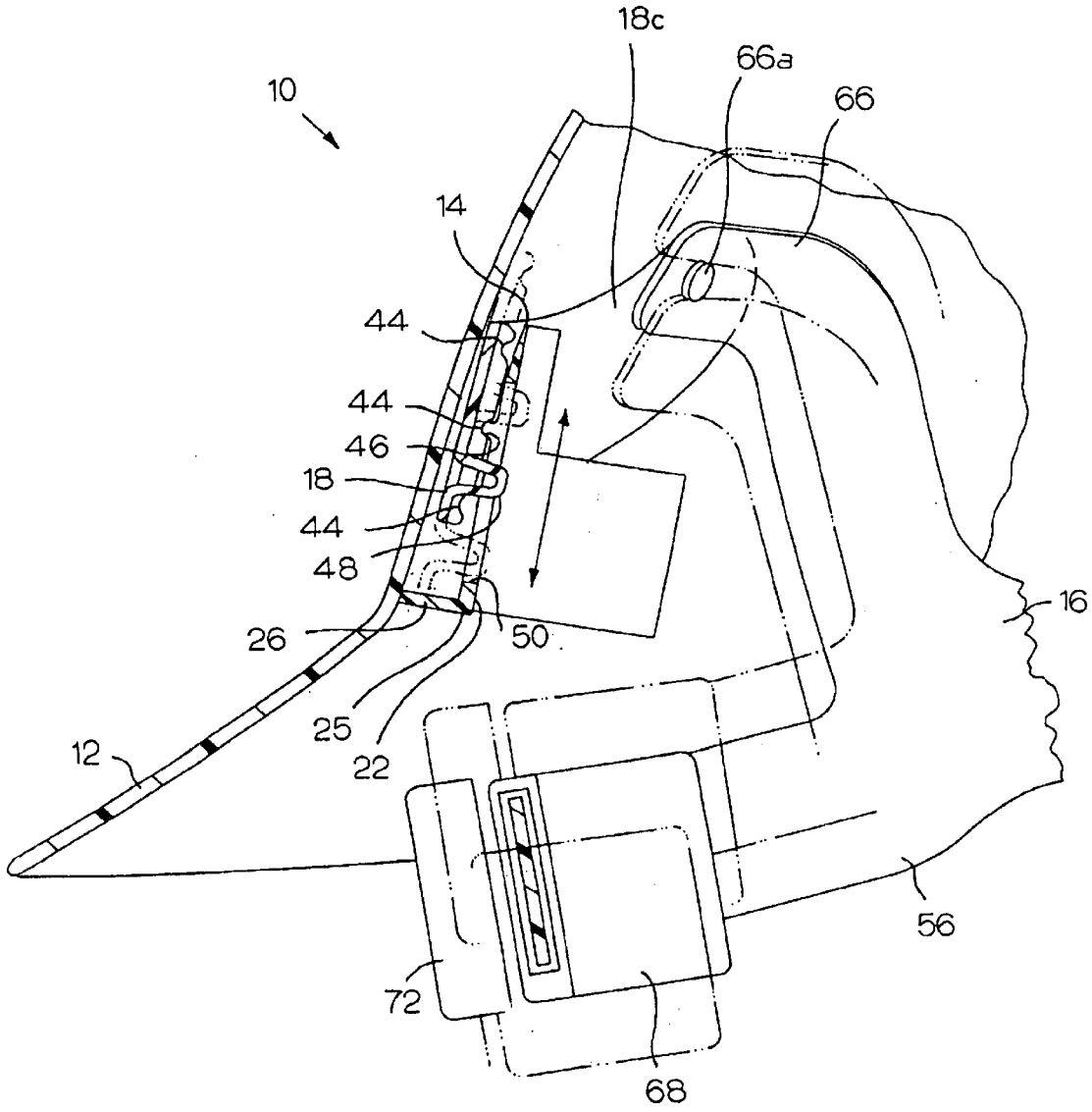
FIG. 8 is an enlarged sectional view of the vertical adjustment mechanism of the headband of the protective helmet of FIG. 1, taken along line 8—8 of FIG. 2.

Referring to the sectional view of FIG. 8, in this exemplary embodiment, the inner ring 14 includes an integral flange 26 that extends from the lower edge 25 of the ring 14. This flange 26 serves to maintain some separation between the outer shell 12 and the outer surface 22 of the inner ring 14, thereby defining a cavity between the shell 12 and the inner ring 14 adapted to enclose the adjustment mechanism 18 and limit the downward vertical movement of the adjustment mechanism 18. Referring still to FIG. 8, detents or indentations 44 are defined at vertically spaced intervals along the adjustment mechanism 18, preferably on either side of the control button 48, each of which is adapted to receive and mate with a respective boss 46 extending from the outer surface 22 of the ring 14 on either side of the aperture 50. When the bosses 46 are so mated with the detents 44 of the adjustment mechanism 18, the adjustment mechanism 18 is prevented from vertical movement with respect to the inner ring 14.

As mentioned above, the central portion 18*a* of the adjustment mechanism 18 includes an integral control button 48 that extends away from the surface of the adjustment mechanism 18 and is accessible through the aperture 50 defined by the inner ring 14. Thus, when the wearer wishes to adjust the vertical position of the headband 16, pressure may be applied to the control button 48 by placing the thumb or another finger through the aperture 50. By applying a generally upward or downward pressure to the control button 48, the adjustment mechanism 18, along with the headband 16 secured to the adjustment mechanism 18, is moved substantially vertically with respect to the inner ring 14. Specifically, when an adequate pressure is provided, the bosses 46 extending from the outer surface 22 of the ring 14 are disengaged from th, selected detente 44. Continued application of pressure causes the adjustment mechanism 18 to slide against the outer surface 22 of the ring 14 until the bosses 46 engage the next set of detents 44. Thus, the adjustment mechanism 18 may be manipulated and moved vertically within the cavity defined by the outer shell 12 and the wring 14 until the bosses 46 on the inner surface 24 of the ring 14 are aligned with desired detents 44. When the pressure on the control button 48 is released, the protruding bosses 46 are again mated with the detents 44, preventing further vertical movement of the adjustment mechanism 18 and associated headband 16 with respect to the ring 14. The adjusting mechanism 18 is essentially locked relative to the ring 14 and the shell 12, and the headband 16 is maintained at the desired vertical position within the helmet 10.

Therefore, the headband of a protective helmet made in accordance with the present invention can be quickly, easily, and efficiently adjusted by applying pressure to a control button that is readily accessible either by removing the helmet or pivoting it forward on the head of the wearer. Furthermore, a single finger can be used to apply the necessary pressure and effectuate the vertical movement of the headband relative to the outer shell of the protective helmet.

It will be obvious to those skilled in the art that further modifications may be made to the embodiments described herein without departing from the spirit and scope of the present invention.

What is claimed is:

1. A protective helmet, comprising:

a substantially rigid outer shell defining a bottom opening and an internal cavity for receiving a wearer's head;

an inner ring positioned substantially within and secured to said outer shell, said inner ring circumscribing an opening for receiving the wearer's head;

a suspension secured to said inner ring;

a headband positioned substantially within said outer shell and adjacent the bottom opening of said outer shell, wherein the position of said headband relative to the inner ring can be manipulated, effectively adjusting the vertical position of the headband within and relative to the outer shell; and an adjustment mechanism connected to said headband, said adjustment mechanism including control button accessible through an aperture defined through said inner ring, manipulation of said control button causing vertical movement of said adjustment mechanism and the connected headband with respect to the inner ring.

2. The protective helmet as recited in claim 1, wherein said inner ring includes an integral flange that extends from a lower edge of the ring, which serves to maintain separation between said outer shell and the inner ring, thereby defining a cavity between the outer shell and the inner ring adapted to receive and substantially enclose the adjustment mechanism.

3. The protective helmet as recited in claim 2, wherein the headband is positioned within the inner ring such that a brow portion of the headband abuts an inner surface of a front portion of the inner ring, with arms of the headband abutting and extending beyond the inner surface near a rear portion of the inner ring, said headband being connected to the inner ring by wrapping a cradle portion of the headband around the front portion of the inner ring, sandwiching the front portion of the inner ring between the brow and cradle portions of the headband, the adjustment mechanism then being secured to and between the arms of the headband with the control button extending through the aperture defined by the inner ring.

4. The protective helmet as recited in claim 1, wherein detents are defined at vertically spaced intervals along said adjustment mechanism, each of which is adapted to receive and mate with a respective boss extending from said inner ring.

5. The protective helmet as recited in claim 4, wherein said detents are positioned on either side of said control button and said bosses are positioned on either side of the aperture defined through said inner ring.

6. The protective helmet as recited in claim 1, wherein said headband also includes a mechanism for adjusting its circumference.

7. The protective helmet as recited in claim 1, and further comprising an inner shell positioned within said the outer shell and also defining an opening and an internal cavity for receiving the wearer's head.

8. A protective helmet, comprising:

a substantially rigid outer shell defining a bottom opening and an internal cavity for receiving a wearer's head;

a headband positioned substantially within said outer shell and adjacent the bottom opening of said outer shell;

a suspension positioned within said outer shell;

an inner ring positioned substantially within and secured to said outer shell, said inner ring circumscribing an opening for receiving the wearer's head; and an adjustment mechanism connected to said headband, said adjustment mechanism including a control button accessible through an aperture defined through said inner ring, manipulation of said control button causing vertical movement of said adjustment mechanism and the connected headband with respect to the inner ring.

9. The protective helmet as recited in claim 8, wherein said inner ring includes an integral flange that extends from a lower edge of the ring, which serves to maintain separation between said outer shell and the inner ring, thereby defining a cavity between the outer shell and the inner ring adapted to receive and enclose the adjustment mechanism.

10. The protective helmet as recited in claim 9, wherein detents are defined at vertically spaced intervals along said adjustment mechanism, each of which is adapted to receive and mate with a respective boss extending from said inner ring.

11. The protective helmet as recited in claim 10, wherein said detents are positioned on either said of said control button and said bosses are positioned on either side of the aperture defined through said inner ring.

12. The protective helmet as recited in claim 9, wherein the headband is positioned within the inner ring such that a brow portion of the headband abuts an inner surface of a front portion of the inner ring, with arms of the headband abutting and extending beyond the inner surface near a rear portion of the inner ring, said headband being connected to the inner ring by wrapping a cradle portion of the headband around the front portion of the inner ring, sandwiching the from portion of the inner ring between the brow and cradle portions of the headband, the vertical adjustment mechanism then being secured to and between the arms of the headband with the control button extending through the aperture defined by the inner ring.

13. The protective helmet as recited in claim 8, wherein said headband includes a mechanism for adjusting its circumference.

14. The protective helmet as recited in claim 8, and further comprising an inner shell positioned within the outer shell and also defining an opening and an internal cavity for receiving the wearer's head.

* * * * *